US008302326B2

(12) United States Patent
Lee

(10) Patent No.: US 8,302,326 B2
(45) Date of Patent: Nov. 6, 2012

(54) STEAM DRYER CONTROL METHOD

(75) Inventor: Ju Dong Lee, Incheon (KR)

(73) Assignee: Daewoo Electronics Corporation (KR)

( * ) Notice: Subject to any disclaimer, the term of this patent is extended or adjusted under 35 U.S.C. 154(b) by 420 days.

(21) Appl. No.: 12/548,806

(22) Filed: Aug. 27, 2009

(65) Prior Publication Data

US 2010/0050467 A1 Mar. 4, 2010

(30) Foreign Application Priority Data

Aug. 28, 2008 (KR) ..... 10-2008-0084215

(51) Int. Cl.
*F26B 3/00* (2006.01)
*F26B 7/00* (2006.01)
*F26B 5/04* (2006.01)

(52) U.S. Cl. ..... 34/499; 34/390; 34/486; 34/411

(58) Field of Classification Search ..... 34/499, 34/390, 486, 381, 389, 411, 542
See application file for complete search history.

(56) References Cited

U.S. PATENT DOCUMENTS

| | | | | |
|---|---|---|---|---|
| 7,325,330 | B2 * | 2/2008 | Kim et al. | 34/407 |
| 2005/0016012 | A1 * | 1/2005 | Yang et al. | 34/486 |
| 2006/0101586 | A1 * | 5/2006 | Park et al. | 8/149 |
| 2006/0117596 | A1 * | 6/2006 | Kim et al. | 34/607 |
| 2008/0148596 | A1 * | 6/2008 | Son et al. | 34/486 |

FOREIGN PATENT DOCUMENTS

WO WO2007/128424 A1 * 11/2007

* cited by examiner

*Primary Examiner* — Kenneth Rinehart
*Assistant Examiner* — Corey J Hall
(74) *Attorney, Agent, or Firm* — Schmeiser, Olsen & Watts, LLP

(57) ABSTRACT

A steam dryer control method controls the amount of water supplied to a heater to adjust an amount of steam. The steam dryer control method includes turning on a steam heater, turning on a water supply valve and counting the number of lapses of unit water supply duration at any time when the unit water supply duration elapses, and rotating a drum when the number of lapses of the unit water supply duration reaches a preset number.

4 Claims, 2 Drawing Sheets

STEAM DRYER CONTROL METHOD

BACKGROUND OF THE INVENTION

1. Field of the Invention

The present invention relates to steam dryers and, more particularly, to a steam dryer control method, in which the amount of water supplied to a heater is controlled to adjust an amount of steam.

2. Description of the Related Art

In general, dryers such as dryer-compatible washing machines or laundry dryers heat air using a heater and supply the heated air into a drum to dry laundry. The dryers can be classified into an exhaust type dryer and a condensation type dryer according to the way in which moisture generated by drying the laundry is treated.

In the exhaust type dryer, moisture discharged from the drum is exhausted along with supplied air from the dryer, and in the condensation type dryer, air discharged from the drum passes through a condenser to remove moisture from the air so that the air can be circulated in a dry state to the drum.

The condensation type dryer generally includes a drum in which laundry is dried, a filter for separating foreign matter, a heat exchanger (or condenser) for removing moisture from the laundry through heat exchange, a fan for generating a flow of air to facilitate a drying operation, a heater for heating air to reduce time for the drying operation, and a pipe connecting the respective components to one another.

A washing operation generally results in wrinkled laundry and such wrinkles are not completely removed from the laundry by the drying operation. Thus, a steam dryer has been recently developed, which can remove wrinkles from the laundry using steam.

It should be noted that the aforementioned technique is described for understanding the related art of the invention and is not a well-known conventional technique in the art.

A conventional steam dryer controls supply of steam based on humidity. In this case, the humidity is detected after laundry is wetted with steam or when the steam directly collides with a humidity sensor, so that timing of detecting the humidity occurs too soon or too late, thereby retarding a time point for turning-on/off a drum motor. As a result, the laundry becomes excessively damp due to the steam or is insufficiently wetted therewith.

Moreover, retardation in controlling the drum motor resulting from retardation of humidity detection can cause steam exhaust and steam concentration on part of laundry.

SUMMARY OF THE INVENTION

The present invention is conceived to solve the problems of the related art, and an aspect of the invention is to provide a steam dryer control method, in which the amount of steam is preset depending on the amount of water supplied through a water supply valve for unit water supply duration to allow the water supply valve to be controlled depending on the preset steam amount to thereby supply a proper amount of steam into a drum.

Another aspect of the invention is to provide a steam dryer control method, in which operation of a drum motor is controlled depending on the amount of water supplied through a water supply valve to operate the drum motor in a proper timing during a steam drying cycle such that laundry can be sufficiently wetted with steam.

In accordance with an aspect of the invention, a steam dryer control method includes: turning on a steam heater; turning on a water supply valve and counting the number of lapses of unit water supply duration at any time when the unit water supply duration elapses; and rotating a drum when the number of lapses of the unit water supply duration reaches a preset number.

The rotating a drum may include: determining whether a steam drying cycle is completed, after rotating the drum; if the steam drying cycle is completed, determining whether an actual humidity inside the drum is less than or equal to a preset humidity; and if the actual humidity is greater than the preset humidity, turning on a drying heater.

The preset number of elapses may be varied depending on laundry texture, laundry material, and laundry weight.

In accordance with another aspect of the invention, a steam dryer control method includes: turning on a steam heater; turning on a water supply valve and determining whether a preset duration has elapsed; and rotating a drum if the preset duration has elapsed.

The rotating a drum may include: determining whether a steam drying cycle is completed, after rotating the drum; if the steam drying cycle is completed, determining whether an actual humidity inside the drum is less than or equal to a preset humidity; and if the actual humidity is greater than the preset humidity, turning on a drying heater.

The preset number of elapses may be varied depending on laundry texture, laundry material, and laundry weight.

BRIEF DESCRIPTION OF THE DRAWINGS

The above and other aspects, features, and advantages of the invention will become apparent from the following detailed description of embodiments of the invention in conjunction with the accompanying drawings, in which.

DETAILED DESCRIPTION OF THE EMBODIMENTS

Embodiments of the invention will hereinafter be described in detail with reference to the accompanying drawings.

Figure 1:
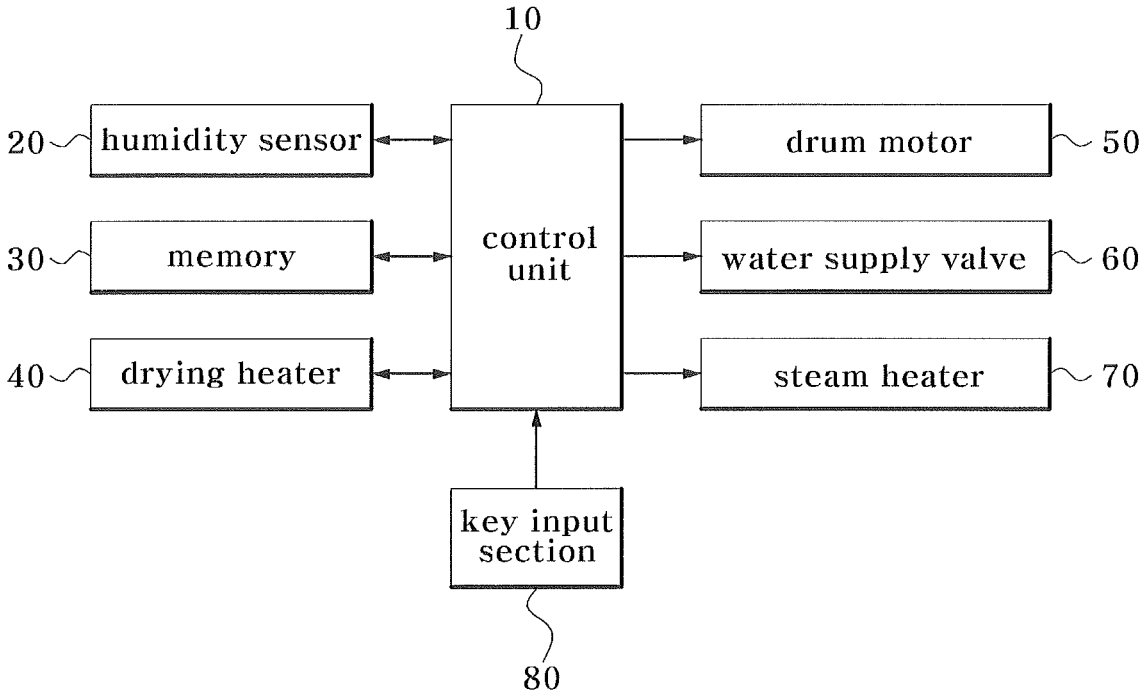
FIG. 1 is a block diagram of a steam dryer controller in accordance with one embodiment of the present invention.

FIG. 1 is a block diagram of a steam dryer controller in accordance with one embodiment of the invention.

Referring to FIG. 1, the steam dryer controller in accordance with the embodiment includes a control unit 10, a humidity sensor 20, a memory 30, a drying heater 40, a drum motor 50, a water supply valve 60, a steam heater 70, and a key input section 80.

The humidity sensor 20 detects the humidity inside a drum that acts as a drying chamber during a drying operation.

The memory 30 stores a variety of programs for operation of the steam dryer controller, data of unit water supply duration during which the water supply valve 60 is operated, and data of the number of lapses of the unit water supply duration or data of preset duration of turning on the water supply valve 60.

When the water supply valve 60 is repetitiously turned on for a predetermined duration, the amount of water supplied for the duration during which the water supply valve 60 is turned on becomes substantially constant, so that the amount of steam supplied into the drum becomes substantially constant.

With these characteristics, the number of lapses of unit water supply duration is counted to adjust the amount of steam by controlling the supply amount of water based on the number of lapses of the unit water supply duration. Herein, the term "unit water supply duration" refers to unit period of time, for which the water supply valve 60 is turned on to adjust the amount of steam generated within the drum.

By counting the number of lapses of the unit water supply duration, it is possible to check the overall water supply duration, via which the amount of steam supplied into the drum can be checked. Therefore, it is possible to solve inaccuracy in humidity detection in the case of detecting the humidity inside the drum using the conventional humidity sensor and to prevent laundry from being excessively wetted with steam or prevent steam from being concentrated on part of the laundry.

The drying heater 40 heats air sucked into the dryer and allows heated air to be supplied into the drum through a drying duct (not shown) connected to the drum, thereby raising the inner temperature of the drum to dry the laundry.

The drum motor 50 rotates the drum and is connected to a rotational shaft of the drum via a power transmission such as a belt or the like. With this configuration, the drum motor 50 transmits a force to the drum via the belt to rotate the drum in accordance with a control signal from the control unit 10.

The water supply valve 60 supplies water to a steam device (not shown) or blocks water supply thereto by opening or closing a water supply pipe connected to the steam device.

The steam heater 70 heats water reserved in the steam device. When water is supplied into the steam device through the water supply pipe, the steam heater 70 heats the water in the steam device and supplies the heated water into the drum through a steam hose (not shown).

The key input section 80 generates key signals in accordance with key manipulation of a user and is disposed on a front panel of the steam dryer to set a variety of steam drying options for a steam drying operation.

When a key signal is input through the key input section 80, the control unit 10 turns on the steam heater 70 to remove remaining water from the steam heater 70 and then turns on the water supply valve 60. Here, the control unit 10 counts the number of lapses of unit water supply duration, for example, 0.14~0.16 sec, as stored in the memory 30, and turns on the drum motor 50 to rotate the drum when the number of lapses of the unit water supply duration reaches a preset number of lapses. Then, the drum is rotated and steam generated by the steam heater 70 is supplied to the laundry. Next, it is determined whether a steam drying cycle is completed. If the steam drying cycle is completed, it is determined whether an actual humidity detected by the humidity sensor 20 is less than or equal to a preset humidity inside the drum. If the actual humidity is greater than the preset humidity, the control unit turns on the drying heater 70 to supply heated air into the drum. When the actual humidity becomes less than or equal to the preset humidity by supplying the heated air, the drying heater 40 is turned off to cool the laundry.

For reference, as a method for determining whether the steam drying cycle is completed, the control unit counts the number of lapses of duration set for a preset steam drying cycle according to a steam drying option or counts the number of operations of the drum motor 50 after the water supply valve 60 is turned on. Here, counting the number of operations of the drum motor 50 after turning on the water supply valve 60 is performed to determine whether the dryer reaches the steam drying cycle within the preset number of operations of the drum motor 50.

Figure 2:
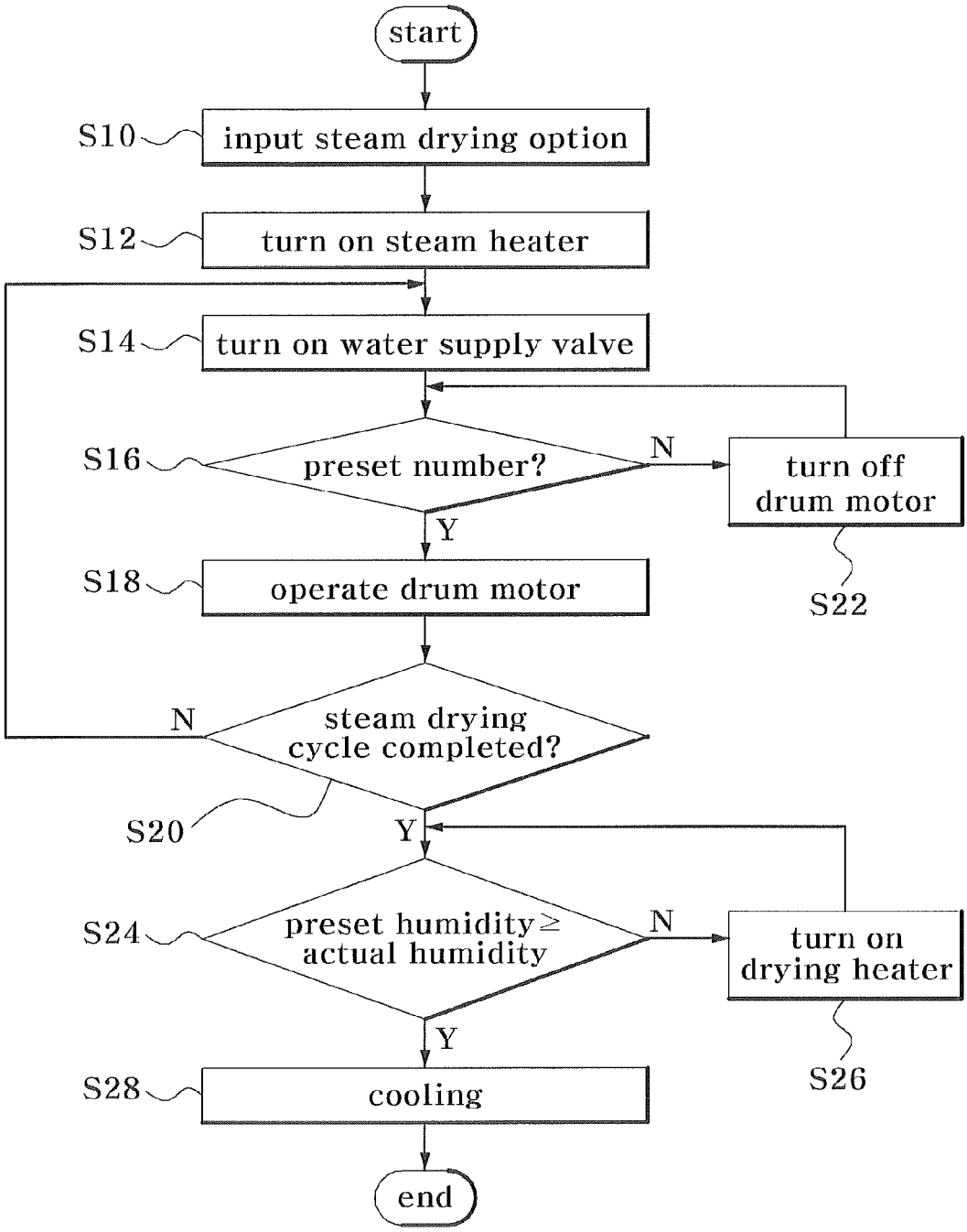
FIG. 2 is a flowchart of a steam dryer control method in accordance with one embodiment of the present invention.

FIG. 2 is a flowchart of a steam dryer control method in accordance with one embodiment of the invention.

For reference, the steam dryer performs a steam drying cycle to supply steam to laundry before performing a drying cycle. In the steam drying cycle, steam is generated by supplying water to the steam heater 70 through the water supply valve 60 and the generated steam is supplied into the drum. The steam drying cycle is repetitiously performed at least once or more according to a preset steam drying option for the steam drying cycle.

The steam dryer control method according to this embodiment includes inputting a steam drying option for a steam drying cycle by manipulating the key input section 80 in S10, and turning on, by the control unit 10, the steam heater 70 to remove remaining water from the steam device in S12.

Duration for turning on the steam heater 10 may be determined depending on the remaining amount of water, which can be varied in accordance with the size and structure of the steam device.

After removing the remaining water from the steam device by turning on the steam heater 70, the control unit 10 turns on the water supply valve 60 to supply water into the steam device in S14.

Here, the control unit 10 reads out unit water supply duration from the memory 30 and determines whether the number of lapses of the unit water supply duration reaches a preset number of lapses by counting the number of lapses of the unit water supply duration at any time when the unit water supply duration elapses, in S16.

The control unit 10 turns off the drum motor 50 until the number of lapses of the unit water supply duration reaches the preset number of lapses, in S22. If the number of lapses of the unit water supply duration reaches the preset number of lapses, the control unit 10 turns on the drum motor 50 in S18.

Here, the preset number can be varied depending on the steam drying option, the laundry amount, laundry texture, laundry material, laundry weight, and the like.

After turning on the drum motor 50, the control unit 10 rotates the drum for an operating time of the drum motor, that is, preset duration according to the steam drying option, and determines whether the steam drying cycle is completed if the preset duration has elapsed, in S20.

As described above, determining whether the steam drying cycle is completed serves to determine whether a preset duration for a predetermined steam drying cycle according to the steam drying option has elapsed or whether the number of operations of the drum motor 50 has reached a predetermined number of operations after the water supply valve 60 is turned on.

If the steam drying cycle is not completed, the water supply valve 60 is turned on and the processes described above are repeated until the preset duration for the predetermined steam drying cycle according to the steam drying option elapses or until the number of operations of the drum motor 50 reaches the predetermined number after the water supply valve 60 is turned on.

If the steam drying cycle is completed, it is determined whether an actual humidity of the drum input from the humidity sensor 20 is less than or equal to a preset humidity according to the steam drying option in S24. Here, if the actual humidity is greater than the preset humidity, the drying heater 40 is turned on to supply heated air into the drum in S26.

This operation is repeated until the actual humidity becomes less than or equal to the preset humidity. When the actual humidity becomes less than or equal to the preset humidity, the drying heater 40 is turned off to cool the interior of the drum in S28.

Here, the preset humidity may be varied according to the steam drying option for the steam drying cycle and is set to be less than the actual humidity in the case where the steam drying cycle is completed. Therefore, if the steam drying cycle is completed, since the actual humidity of the drum becomes greater than the preset humidity, the drying heater 40 is turned on to supply heated air into the drum until the actual humidity of the drum becomes less than or equal to the preset humidity.

In this embodiment, the dryer is illustrated as rotating the drum depending on whether the number of lapses of the unit water supply duration has reached the preset number of elapses by counting the number of lapses of the unit water supply duration. This operation is performed to control the total amount of steam supplied into the drum depending on the unit water supply time. Therefore, the method may include setting duration of operating the water supply valve or may adopt other methods in order to supply a proper amount of steam into the drum. In other words, duration for turning on the water supply valve 60 is individually set depending on various steam drying options, for example, laundry texture, laundry material, laundry weight and the like, and the drum may be rotated when the duration elapses.

According to the embodiments of the invention, a preset amount of steam is determined depending on the amount of water supplied through the water supply valve for unit water supply duration and the water supply valve is controlled depending on the preset amount of steam, thereby supplying a proper amount of steam into a drum.

Further, the operation of the drum motor is controlled depending on the amount of water supplied through a water supply valve to operate the drum motor with proper timing during steam drying, so that laundry can be sufficiently wetted with steam.

Although some embodiments have been provided to illustrate the invention in conjunction with the drawings, it will be apparent to those skilled in the art that the embodiments are given by way of illustration only, and that various modifications and equivalent embodiments can be made without departing from the spirit and scope of the invention. The scope of the invention should be defined only by the accompanying claims.

What is claimed is:

1. A steam dryer control method comprising:

turning on a steam heater;

turning on a water supply valve and counting the number of lapses of unit water supply period at any time when the unit water supply period elapses; and rotating a drum when the number of lapses of the unit water supply period reaches a preset number, wherein rotating the drum includes the steps of:

determining whether a steam drying cycle is completed, after rotating the drum;

if the steam drying cycle is completed, determining whether an actual humidity inside the drum is less than or equal to a preset humidity;

if the steam drying cycle is not completed, returning to the step of turning on the water supply valve; and if the actual humidity is greater than the preset humidity, turning on a drying heater;

if the actual humidity is not greater than the preset humidity, cooling an interior of the drum, and wherein determining whether the steam drying cycle is completed depends on whether the number of operations of a drum motor has reached a predetermined number of operations after the water supply valve is turned on.

2. The method according to claim 1, wherein the preset number is varied depending on at least one of laundry texture, laundry material and laundry weight.

3. A steam dryer control method comprising:

turning on a steam heater;

turning on a water supply valve and determining whether a preset duration has elapsed; and rotating a drum if the preset duration has elapsed, wherein rotating the drum includes the steps of:

determining whether a steam drying cycle is completed, after rotating the drum;

if the steam drying cycle is completed, determining whether an actual humidity inside the drum is less than or equal to a preset humidity;

if the steam drying cycle is not completed, returning to the step of turning on the water supply valve; and if the actual humidity is greater than the preset humidity, turning on a drying heater;

if the actual humidity is not greater than the preset humidity, cooling an interior of the drum, and wherein determining whether the steam drying cycle is completed depends on whether the number of operations of a drum motor has reached a predetermined number of operations after the water supply valve is turned on.

4. The method according to claim 3, wherein the preset number is varied depending on at least one of laundry texture, laundry material and laundry weight.

* * * * *